US009434564B2

(12) United States Patent
Yokoyama

(10) Patent No.: US 9,434,564 B2
(45) Date of Patent: Sep. 6, 2016

(54) SHEET TRANSPORTING MEMBER, SHEET TRANSPORTING DEVICE, AND IMAGE FORMING APPARATUS

(71) Applicant: FUJI XEROX CO., LTD., Tokyo (JP)

(72) Inventor: Tomohiro Yokoyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/520,666

(22) Filed: Oct. 22, 2014

(65) Prior Publication Data

US 2015/0259165 A1 Sep. 17, 2015

(30) Foreign Application Priority Data

Mar. 13, 2014 (JP) ..... 2014-049663

(51) Int. Cl.
*B65H 5/06* (2006.01)
*B65H 3/52* (2006.01)

(52) U.S. Cl.
CPC ..... *B65H 5/062* (2013.01); *B65H 3/5207* (2013.01); *B65H 2402/10* (2013.01); *B65H 2402/441* (2013.01); *B65H 2402/5152* (2013.01); *B65H 2402/5164* (2013.01); *B65H 2404/135* (2013.01); *B65H 2404/1342* (2013.01); *B65H 2404/611* (2013.01); *B65H 2601/324* (2013.01)

(58) Field of Classification Search
CPC .... B65H 5/068; B65H 3/06; B65H 2402/10; B65H 2402/5164; B65H 2402/5152; B65H 2402/5153; B65H 2404/15; B65H 2404/10; B65H 2404/1342; B65H 2601/324
See application file for complete search history.

(56) References Cited

U.S. PATENT DOCUMENTS

| | | | | |
|---|---|---|---|---|
| 5,040,779 | A * | 8/1991 | Ogiri et al. | 271/109 |
| 6,059,280 | A * | 5/2000 | Yamauchi et al. | 271/109 |
| 7,731,174 | B2 * | 6/2010 | Lee et al. | 271/109 |
| 7,913,996 | B2 * | 3/2011 | Nishikata et al. | 271/162 |
| 8,196,918 | B2 * | 6/2012 | Arimura et al. | 271/124 |
| 8,256,762 | B2 * | 9/2012 | Blair et al. | 271/126 |
| 8,475,069 | B2 * | 7/2013 | Takahashi | 400/641 |
| 8,894,061 | B2 * | 11/2014 | Matsuoka | 271/10.13 |
| 9,079,716 | B2 * | 7/2015 | Kawashima | |
| 2015/0097334 | A1 * | 4/2015 | Sekiguchi et al. | 271/275 |

FOREIGN PATENT DOCUMENTS

| | | |
|---|---|---|
| JP | 2012-078637 A | 4/2012 |
| JP | 2012-240767 A | 12/2012 |

* cited by examiner

*Primary Examiner* — Patrick Cicchino
(74) *Attorney, Agent, or Firm* — Oliff PLC

(57) ABSTRACT

Provided is a sheet transporting member including a shaft portion that includes a first shaft portion rotated by receiving a driving force on one end side and a second shaft portion of which one end is pivotably connected to the first shaft portion on the other end side of the first shaft portion, a covering member that is changed over between a first posture in which the covering member covers a connecting portion to which the second shaft portion is pivotably connected so as to allow the second shaft portion to stop pivoting, and a second posture in which the covering member does not cover the connecting portion, and a roller portion that is provided on the shaft portion and comes into contact with a sheet to transport the sheet.

4 Claims, 8 Drawing Sheets

SHEET TRANSPORTING MEMBER, SHEET TRANSPORTING DEVICE, AND IMAGE FORMING APPARATUS

CROSS-REFERENCE TO RELATED APPLICATIONS

This application is based on and claims priority under 35 USC 119 from Japanese Patent Application No. 2014-049663 filed Mar. 13, 2014.

BACKGROUND

Technical Field

The present invention relates to a sheet transporting member, a sheet transporting device, and an image forming apparatus.

SUMMARY

According to an aspect of the invention, there is provided a sheet transporting member including:

a shaft portion that includes a first shaft portion rotated by receiving a driving force on one end side and a second shaft portion of which one end is pivotably connected to the first shaft portion on the other end side of the first shaft portion;

a covering member that is changed over between a first posture in which the covering member covers a connecting portion to which the second shaft portion is pivotably connected so as to allow the second shaft portion to stop pivoting, and a second posture in which the covering member does not cover the connecting portion; and a roller portion that is provided on the shaft portion and comes into contact with a sheet to transport the sheet.

BRIEF DESCRIPTION OF THE DRAWINGS

Exemplary embodiments of the present invention will be described in detail based on the following figures, wherein.

DETAILED DESCRIPTION

Figure 1:
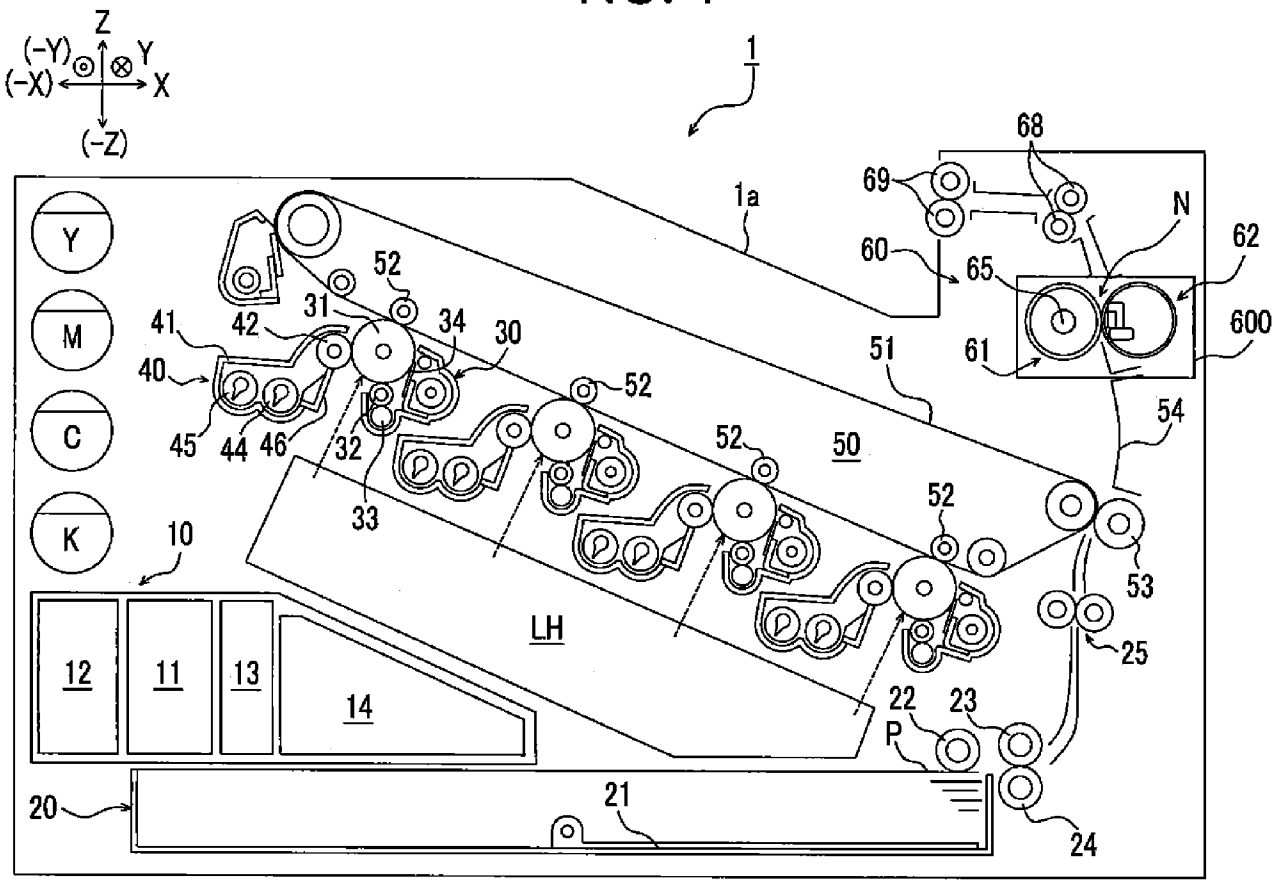
FIG. 1 is a schematic longitudinal cross-sectional view illustrating the internal configuration of an image forming apparatus.

The invention will now be described in more detail using the following exemplary embodiments and specific examples with reference to the drawings, but the invention is not limited to the exemplary embodiments and the specific examples.

In addition, in the following description which uses the drawings, it should be noted that the drawings are schematic and the ratios of the dimensions and the like are different from those in reality, and for ease of understanding, illustration of members other than the members that need an explanation is appropriately omitted.

For ease of understanding of the following description, in the drawings, the forward and backward direction is referred to as an X-axis direction, the left and right direction is referred to as a Y-axis direction, and the up and down direction is referred to as a Z-axis direction.

(1) Entire Configuration and Operation of Image Forming Apparatus

FIG. 1 is a schematic cross-sectional view illustrating the internal configuration of an image forming apparatus 1 according to this exemplary embodiment.

Hereinafter, the entire configuration and the operation of the image forming apparatus 1 will be described with reference to the drawings.

(1.1) System Configuration of Image Forming Apparatus

The image forming apparatus 1 is configured to include a control device 10, a sheet transporting device 20, photoreceptor units 30, developing devices 40, a transfer device 50, and a fixing device 60. On the upper surface (in the Z direction) of the image forming apparatus 1, an output tray 1*a* to which sheets having an image recorded thereon are discharged to be accommodated is formed.

The control device 10 includes an image forming apparatus control unit 11 which controls the operation of the image forming apparatus 1, a controller unit 12 which prepares image data according to a printing request, an exposure control unit 13 which controls the lighting of an exposing device LH, a power source device 14, and the like. The power source device 14 applies voltages to charging rollers 32, developing rollers 42, primary image transfer rollers 52, secondary image transfer rollers 53, and the like, which will be described later, and supplies power to the exposing device LH.

The controller unit 12 converts print information input from an external information transmitting device (for example, a personal computer) into image information for forming a latent image, and outputs a driving signal to the exposing device LH at a predetermined timing.

(1.2) Configuration and Operation of Image Forming Section

At the bottom portion of the image forming apparatus 1, the sheet transporting device 20 is provided. The sheet transporting device 20 includes a sheet cassette 21, and on the upper surface of the sheet cassette 21, a number of sheets as recording media are stacked. The sheets of which the positions in the width direction are determined by a regulating plate (not illustrated) are drawn forward (−X direction) one by one from the top by a nudger roller 22 and thereafter are introduced between a feed roller 23 and a retard roller 24 so that the feed roller 23 comes into contact with the upper surfaces of the sheets. The sheets are transported to a contact portion of a pair of registration rollers 25.

The photoreceptor units 30 are provided above (in the Z direction) the sheet transporting device 20 in parallel and respectively include photosensitive drums 31 as image holding members that are driven to rotate. The charging roller 32, the exposing device LH, the developing device 40, the primary image transfer roller 52, and a cleaning blade 34 are arranged along the rotation direction of the photosensitive drum 31. A cleaning roller 33 which cleans the surface of the charging roller 32 is disposed to oppose and come into contact with the charging roller 32.

The developing device 40 includes a developing housing 41 which accommodates a developer therein. In the developing housing 41, the developing roller 42 which is disposed to oppose the photosensitive drum 31, and a pair of augers 44 and 45 which agitate the developer to be transported to the developing roller 42 side and are disposed obliquely on the lower side of the back surface side of the developing roller 42 are arranged. A layer regulating member 46 which regulates the layer thickness of the developer is disposed close to the developing roller 42.

The developing devices 40 have substantially the same configuration except for the developers accommodated in the developing housings 41 and respectively form toner images of yellow (Y), magenta (M), cyan (C), and black (K).

The surface of the rotating photosensitive drum 31 is charged by the charging roller 32, and on the surface, an electrostatic latent image is formed by a latent image forming light emitted by the exposing device LH. The electrostatic latent image formed on the photosensitive drum 31 is developed as a toner image by the developing roller 42.

The transfer device 50 includes an intermediate image transfer belt 51 on which the respective color toner images formed by the photosensitive drums 31 of the photoreceptor units 30 are transferred to be superimposed, and the primary image transfer rollers 52 which sequentially transfer (primarily transfer) the color toner images respectively formed by the photoreceptor units 30 onto the intermediate image transfer belt 51. The transfer device 50 is configured to further include the secondary image transfer rollers 53 which collectively transfer (secondarily transfer) the color toner images respectively transferred onto the intermediate image transfer belt 51 to be superimposed, onto a sheet P which is a recording medium.

The color toner images respectively formed on the photosensitive drums 31 of the photoreceptor units 30 are sequentially, electrostatically transferred (primarily transferred) onto the intermediate image transfer belt 51 by the primary image transfer rollers 52 to which a predetermined transfer voltage is applied by the power source device 14 or the like controlled by the image forming apparatus control unit 11, thereby forming superimposed toner images in which toners of the respective colors are superimposed.

The superimposed toner images on the intermediate image transfer belt 51 are transported to a region (secondary image transfer portion T) where the secondary image transfer rollers 53 are arranged, along of the movement of the intermediate image transfer belt 51. When the superimposed toner images are transported to the secondary image transfer portion T, the sheet P is supplied to the secondary image transfer portion T from the sheet transporting device 20 according to the timing. In addition, a predetermined transfer voltage is applied to the secondary image transfer rollers 53 from the power source device 14 or the like controlled by the image forming apparatus control unit 11, and the superimposed toner images on the intermediate image transfer belt 51 are collectively transferred onto the sheet P that is fed from the pair of registration rollers 25 and is guided by a transportation guide.

Residual toner on the surface of the photosensitive drum 31 is removed by the cleaning blade 34 and is recovered by a waste developer accommodating unit. The surface of the photosensitive drum 31 is re-charged by the charging roller 32. Residual matter that has not been removed by the cleaning blade 34 and adheres to the charging roller 32 is trapped on the surface of the cleaning roller 33 that is rotated while coming into contact with the charging roller 32, so as to be accumulated.

The fixing device 60 is configured to include a fixing unit 600, a pair of transporting rollers 68, and a pair of discharge rollers 69. The fixing unit 600 includes a heating module 61 and a pressing module 62, and a fixing nip portion N (fixing region) is formed by a pressure contact region between the heating module 61 and the pressing module 62.

The sheet P onto which the toner images are transferred by the transfer device 50 is transported to the fixing device 60 via a transportation guide 54 in a state where the toner images are not fixed yet. The sheet P transported to the fixing device 60 is brought into pressure contact with and is heated by the heating module 61 and the pressing module 62 which form a pair, thereby fixing the toner images.

The sheet P on which the fixed toner image is formed is discharged to the output tray 1*a* on the upper surface of the image forming apparatus 1 from the pair of discharge rollers 69 via the pair of transporting rollers 68.

(2) Configuration and Operation of Sheet Transporting Device

Figure 2:
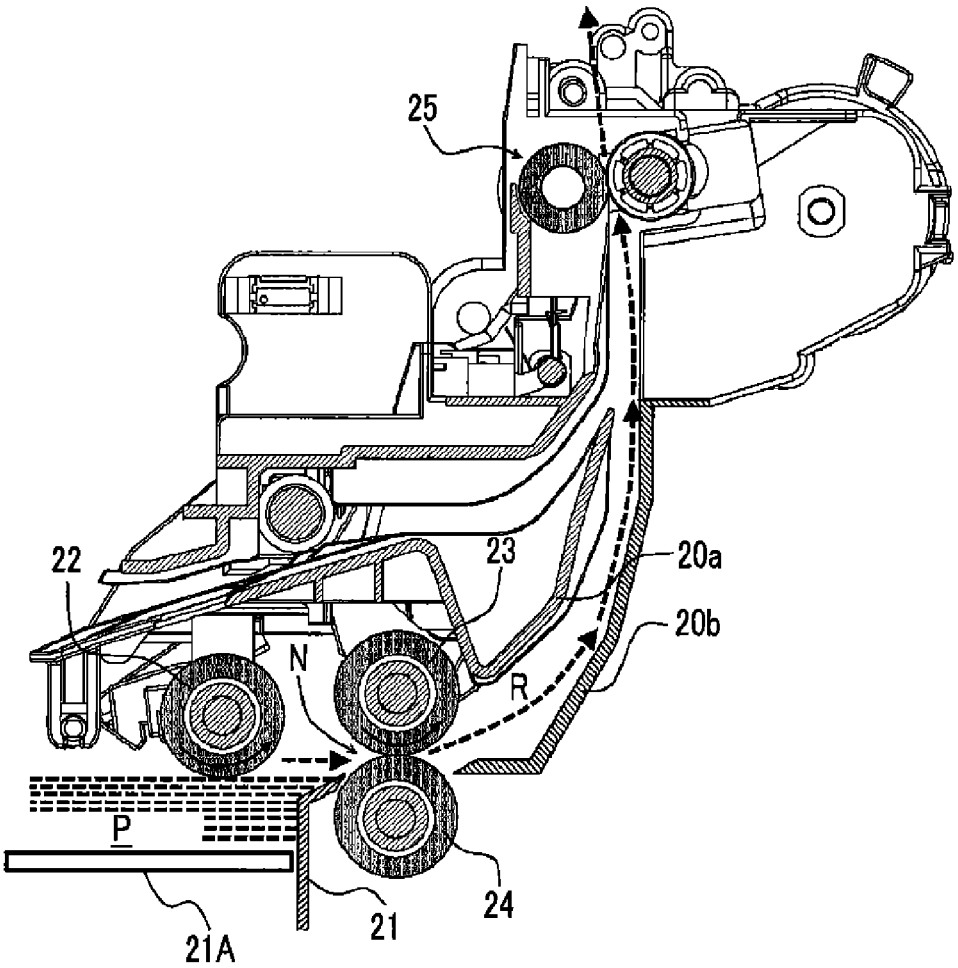
FIG. 2 is a schematic cross-sectional view illustrating the internal configuration (excluding a sheet cassette) and the sheet transporting operation of a sheet transporting device of the image forming apparatus.
Figure 3:
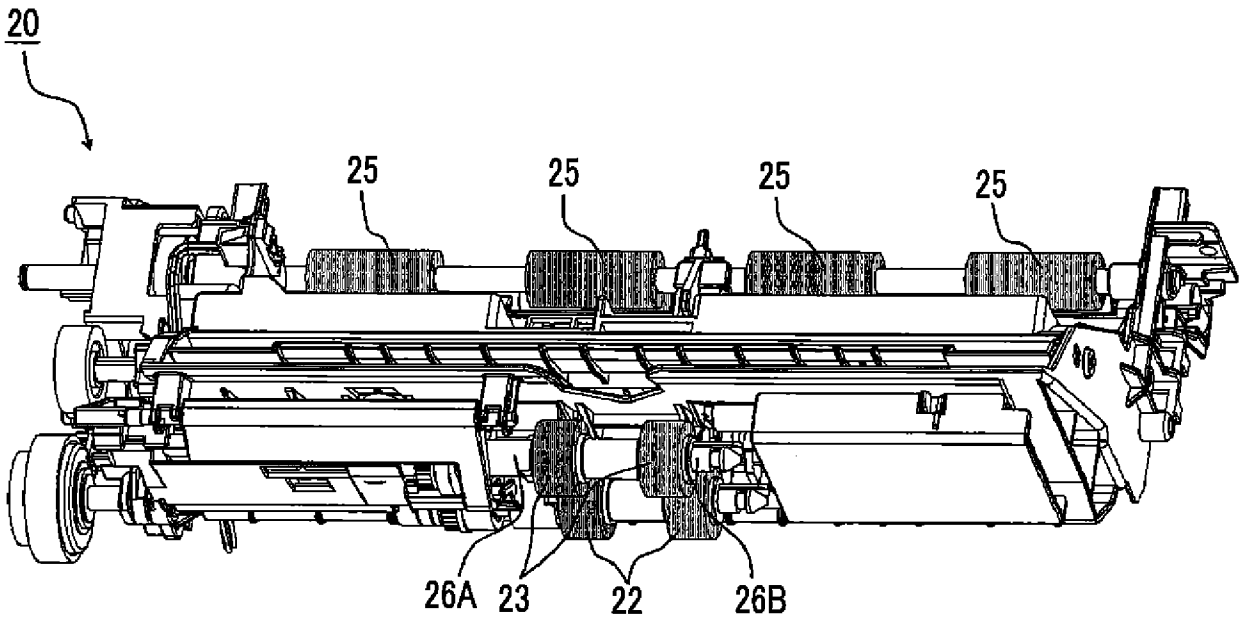
FIG. 3 is a perspective view illustrating the mounting structure of a feed roller of the sheet transporting device.
Figure 4A:
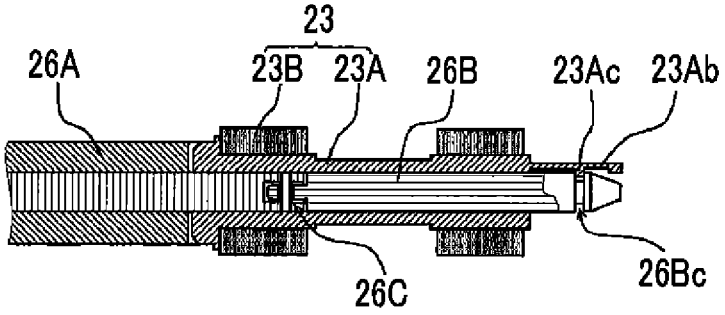
FIG. 4A is a schematic cross-sectional view illustrating the structure of a shaft that supports the feed roller.
Figure 4B:
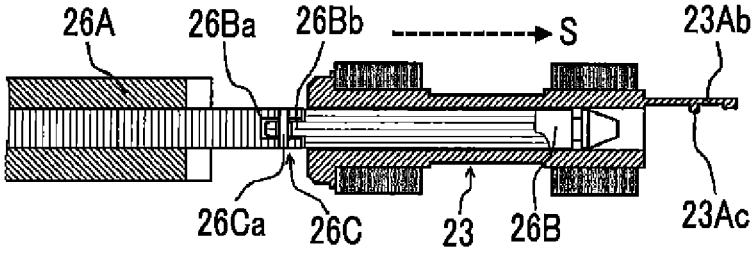
FIG. 4B is a schematic cross-sectional view illustrating a second posture in which the shaft is able to pivot.
Figure 4C:
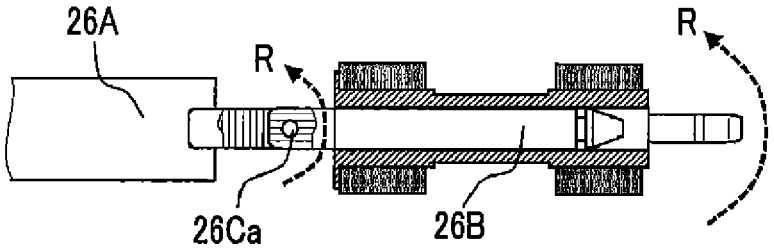
FIG. 4C is a schematic cross-sectional view illustrating a pivoting operation of the shaft.
Figure 5A:
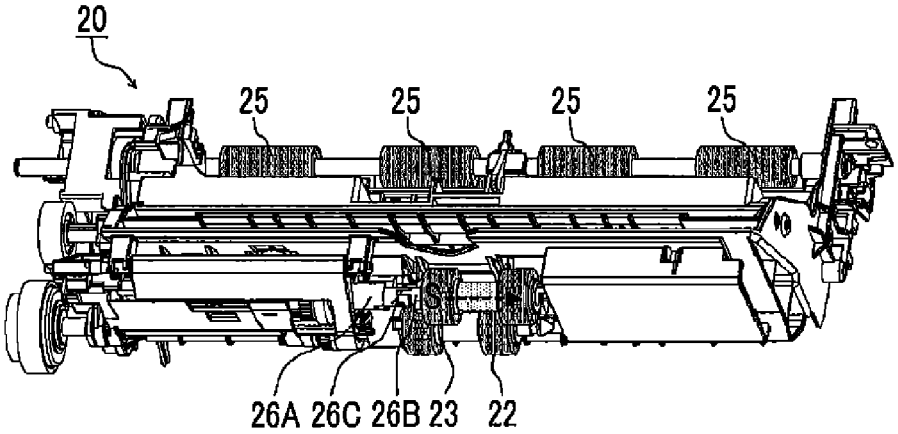
FIGS. 5A to 5C are perspective views illustrating the detaching order of the feed roller.
Figure 5B:
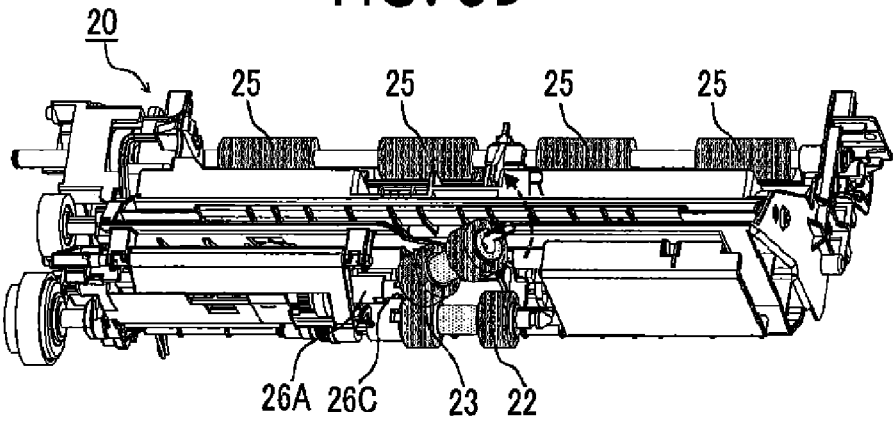
Figure 5C:
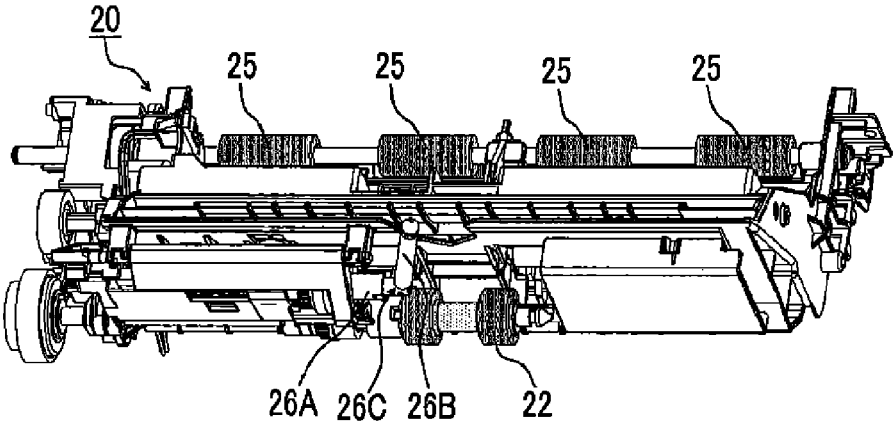

FIG. 2 is a schematic cross-sectional view illustrating the internal configuration (excluding the sheet cassette 21) and the sheet transporting operation of the sheet transporting device 20 of the image forming apparatus 1 according to this exemplary embodiment, FIG. 3 is a perspective view illustrating the mounting structure of the feed roller 23 of the sheet transporting device 20, FIGS. 4A to 4C are schematic cross-sectional views illustrating the support structure of the feed roller 23, and FIGS. 5A to 5C are perspective views illustrating the detaching order of the feed roller 23. Hereinafter, the configuration and the operation of the sheet transporting device 20 of the image forming apparatus 1 will be described with reference to the drawings.

(2.1) Configuration and Sheet Transporting Operation of Sheet Transporting Device The sheet transporting device 20 includes the sheet cassette 21 disposed at the lower portion of the body of the image forming apparatus 1 (see FIG. 1). Immediately above the leading edge side (−X direction in FIGS. 1 and 2) of the sheet cassette 21, the nudger roller 22 which comes into contact with the leading edge side of the upper surface of the sheet P and feeds the sheet P from the sheet cassette 21 is provided.

As illustrated in FIG. 2, in the sheet cassette 21, a sheet stacking plate 21A on which the sheets P are stacked in a bundle form is provided. The sheet stacking plate 21A is urged upward by a spring member (not illustrated) so that the sheet P at the uppermost position among the sheets P stacked on the sheet stacking plate 21A comes into contact with the nudger roller 22.

As a result, even in a case where the stacked sheets P are fed and thus the number of sheets P decreases, the spring member urges the sheet stacking plate 21A upward and thus the sheet P at the uppermost position comes into contact with the nudger roller 22.

On the downstream side in the sheet transport direction of the nudger roller 22, the feed roller 23 as an example of a transporting roller is provided. On the lower side of the feed roller 23, the retard roller (separating roller) 24 as a sheet separating port ion is disposed to oppose the feed roller 23.

Accordingly, a nip portion where the sheet P that is fed from the inside of the sheet cassette 21 is nipped is formed between the feed roller 23 and the retard roller 24.

The feed roller 23 is a driving roller which is driven by a driving unit (not illustrated) provided in the body of the image forming apparatus 1 so as to rotate around its shaft in a direction perpendicular to the sheet transport direction as the axial direction.

As the feed roller 23 comes into contact with the upper surface (surface) of the sheet P that is fed from the sheet cassette 21 and is transported to the nip portion and is driven to rotate, the sheet P is transported to the downstream side.

The retard roller 24 is a follower roller that is rotated around its shaft in the direction perpendicular to the sheet transport direction as the axial direction, and a torque limiter (not illustrated) is attached to the rotating shaft of the retard roller 24.

Therefore, the sheet P comes into contact with the surface of the retard roller 24, and when a rotational force is applied to the retard roller 24 by the friction with the sheet P, the retard roller 24 functions as a brake that generates a predetermined rotational load. When a predetermined rotational force or more is applied to the retard roller 24, the retard roller 24 is driven to rotate.

As described above, since the retard roller 24 functions as the brake, in a case where a number of sheets P overlap and are transported to the nip portion, the retard roller 24 applies transportation resistance to the sheet P from the lower surface side (rear surface side) to suppress a multi-feed of the sheets P transported by the feed roller 23.

That is, the feed roller 23 and the retard roller 24 form a pair, separate (loosen) the overlapping sheets P, and feed the sheets P one by one (see the arrow R in FIG. 2).

Between the pair of registration rollers 25 disposed on the downstream side of the sheet transport direction of the feed roller 23 and the feed roller 23, guide plates 20*a* and 20*b* for guidance to the pair of registration rollers 25 are provided.

In a case where the separation and transportation of the sheets P fed from the nudger roller 22 is continued by the feed roller 23 and the retard roller 24 configured as described above, the surface of the feed roller 23 wears and there is concern of degradation of transporting force.

Therefore, when a given number of supplied sheets are separated and transported, the used feed roller 23 is detached and is replaced with a new feed roller 23.

(2.2) Configuration and Detachment of Transporting Roller

As illustrated in FIG. 3, in the sheet transporting device 20 according to this exemplary embodiment, the feed roller 23 is supported by a shaft 26 as an example of a shaft portion constituted by a first shaft portion 26A that is rotated by receiving a driving force on one end side, and a second shaft portion 26B of which one end is pivotably connected to the first shaft portion 26A on the other end side of the first shaft portion 26A.

As illustrated in FIG. 4A, the feed roller 23 includes a cylinder member 23A as an example of a covering member which is fitted to the shaft 26, and a rubber portion 23B that is press-fitted to the outer circumferential surface of the cylinder member 23A. The cylinder member 23A is supported to be movable in the axial center direction of the shaft 26 between a first posture in which the cylinder member 23A is fitted and integrated with the first shaft portion 26A and is rotatably supported while covering a connecting portion 26C to which the second shaft portion 26B is pivotably connected on the other end side of the first shaft portion 26A of the shaft 26, and a second posture in which the cylinder member 23A is rotatably supported on the second shaft portion 26B.

A groove portion 26Bc is provided in an annular shape on the other end side (leading edge portion) of the second shaft portion 26B, and a claw portion 23Ab having a protrusion 23Ac is formed on the leading edge portion of the cylinder member 23A to be elastically deformable. In addition, when the cylinder member 23A is positioned in the first posture in which the cylinder member 23A is fitted to the second shaft portion 26B and the protrusion 23Ac of the claw portion 23Ab is engaged with the groove portion 26Bc of the second shaft portion 26B to stop pivoting of the feed roller 23 in the axial direction of the shaft 26, the sheets P which come into contact with the retard roller 24 and are fed from the nudger roller 22 are separated and transported.

The connecting portion 26C of the shaft 26 is configured so that a cutout portion 26Ba formed in the other end side of the first shaft portion 26A and a convex portion 26Bb formed in one end of the second shaft portion 26B are fitted to each other to allow the connecting portion 26C to pivot at a pin 26Ca about the pin 26Ca as the rotation center.

In addition, in a state where the engagement between the protrusion 23Ac of the claw portion 23Ab of the cylinder member 23A and the groove portion 26Bc of the second shaft portion 26B is released and is changed over to the second posture in which the cylinder member 23A is rotatably supported on the second shaft portion 26B (see FIG. 4B), the connecting portion 26C is able to pivot about the pin 26Ca as the rotation center (see FIG. 4C).

As described above, in the state where the feed roller 23 is positioned in the second posture in which the feed roller 23 is rotatably supported on the second shaft portion 26B, the feed roller 23 enters a state of being detachable from the shaft 26 by pivoting the second shaft portion 26B forward or downward in the image forming apparatus 1 (see FIGS. 5A to 5C).

Therefore, even in a case where there is not sufficient space in the axial line direction of the shaft 26 of the feed roller 23, the feed roller 23 may be easily detached and replaced.

(2.3) Modification Example of Connecting Portion

Figure 6A:
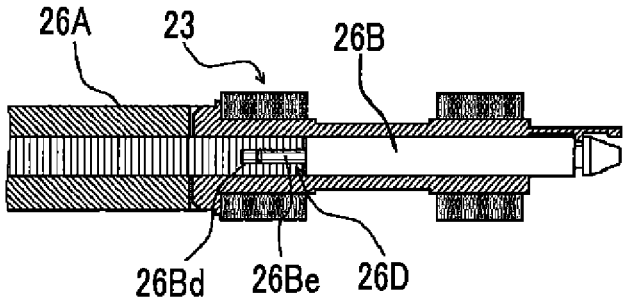
FIG. 6A is a schematic cross-sectional view illustrating a connecting portion according to a modification example of the shaft.
Figure 6B:
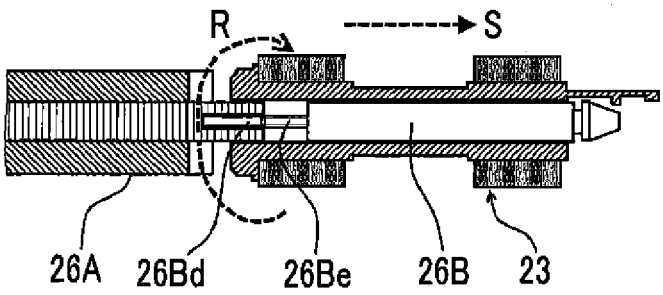
FIG. 6B is a schematic cross-sectional view illustrating a state where the screwing of the connecting portion is released.

FIG. 6A is a schematic cross-sectional view illustrating a connecting portion 26D according to a modification example of the shaft 26, and FIG. 6B is a schematic cross-sectional view illustrating a state where the screwing of the connecting portion 26D is released.

As illustrated in FIG. 6A, in the connecting portion 26D, a screw hole portion 26Bd formed in the second shaft portion 26B on the other end side of the first shaft portion 26A and a screw portion 26Be formed in one end of the second shaft portion 26B are screwed and connected to each other.

In addition, in a case of detaching the feed roller 23, as illustrated in FIG. 6B, the screwing between the screw hole portion 26Bd on the first shaft portion 26A side and the screw portion 26Be of the second shaft portion 26B is released, and the second shaft portion 26B is deviated from the connecting portion 26D and is able to pivot. Accordingly, the feed roller 23 is detached along with the second shaft portion 26B.

Thereafter, the used feed roller 23 is detached from the second shaft portion 26B, and a new feed roller 23 is fitted to the second shaft portion 26B to be screwed to the screw hole portion 26Bd on the first shaft portion 26A side.

According to the connecting portion 26D, even in a case where there is no sufficient space in the axial line direction of the shaft 26 of the feed roller 23, the feed roller 23 may be detached along with the second shaft portion 26B and easily replaced.

(2.4) Modification Example 1 of Shaft Portion

Figure 7A:
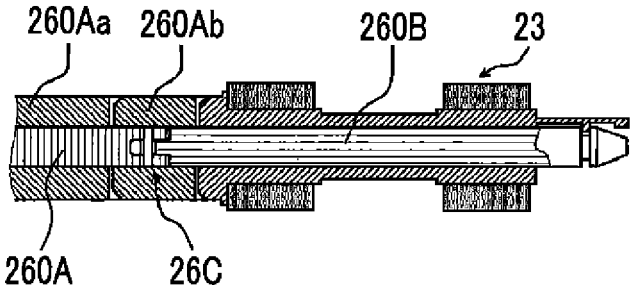
FIGS. 7A and 7B are schematic cross-sectional views illustrating the configuration of a shaft portion of Modification Example 1 and a second posture in which the shaft portion is pivotable.
Figure 7B:
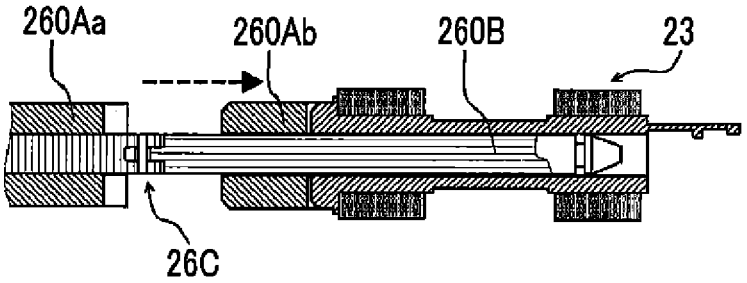

FIGS. 7A and 7B are schematic cross-sectional views illustrating the configuration of a shaft portion of Modification Example 1, which is constituted by a first shaft portion 260A that is rotated by receiving a driving force on one end side, and a second shaft portion 260B of which one end is pivotably connected to the first shaft portion 260A on the other end side of the first shaft portion 260A.

As illustrated in FIG. 7A, the feed roller 23 is positioned in a first posture in which the feed roller 23 is fitted to the second shaft portion 260B and the connecting portion 26C is covered with a first shaft portion 260Ab as an example of a covering member to stop pivoting so that a rotational driving force is transmitted to the feed roller 23.

In a case of exchanging the feed roller 23, as illustrated in FIG. 7B, the first shaft portion 260Ab as the covering member is moved in the axial direction to be changed over to a second posture in which the connecting portion 26C is able to pivot, resulting in a state in which the feed roller 23 is detachable from the second shaft portion 260B by pivoting the second shaft portion 260B forward or downward in the image forming apparatus 1.

(2.5) Modification Example 2 of Shaft Portion

Figure 8A:
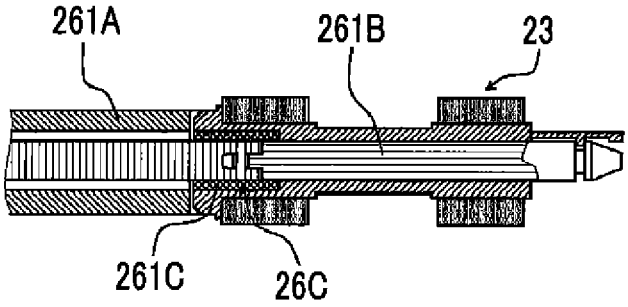
FIGS. 8A and 8B are schematic cross-sectional views illustrating the configuration of a shaft portion of Modification Example 2 and a second posture in which the shaft portion is pivotable.
Figure 8B:
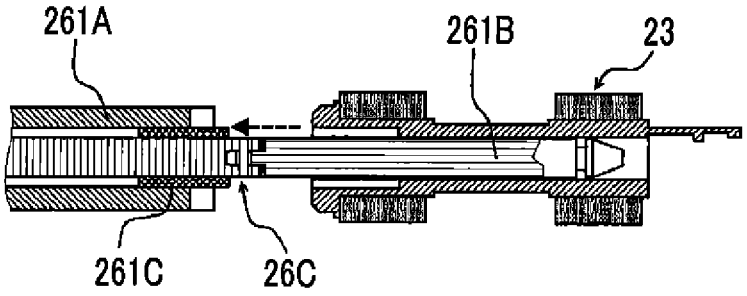

FIGS. 8A and 8B are schematic cross-sectional views illustrating the configuration of a shaft portion of Modification Example 2, which is constituted by a first shaft portion 261A that is rotated by receiving a driving force on one end side, and a second shaft portion 261B of which one end is pivotably connected to the first shaft portion 261A on the other end side of the first shaft portion 261A.

As illustrated in FIG. 8A, the feed roller 23 is positioned in a first posture in which the feed roller 23 is fitted to the second shaft portion 261B and the connecting portion 26C is covered with a cylinder member 261C as an example of a covering member to stop pivoting so that a rotational driving force is transmitted to the feed roller 23.

In a case of exchanging the feed roller 23, as illustrated in FIG. 8B, the cylinder member 261C as the covering member is moved in the axial direction of the first shaft portion 260A to be changed over to a second posture in which the connecting portion 26C is able to pivot, resulting in a state in which the feed roller 23 is detachable from the second shaft portion 261B by pivoting the second shaft portion 261B forward or downward in the image forming apparatus 1.

In this configuration, compared to a case where the first posture and the second posture of the covering member are changed over by moving the first shaft portion in the axial direction, a necessary amount of space in the axial direction for changing over between the first posture and the second posture may be reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transporting member comprising:

a shaft portion that includes a first shaft portion rotated by receiving a driving force on one end side and a second shaft portion of which one end is pivotably connected to the first shaft portion on the other end side of the first shaft portion;

a covering member that is changed over between a first posture in which the covering member covers a connecting portion to which the first shaft portion and second shaft portion are pivotably connected so as to allow the second shaft portion to stop pivoting, and a second posture in which the covering member is rotatably supported on the second shaft portion and does not cover the connecting portion; and a roller portion that is provided on the shaft portion and comes into contact with a sheet to transport the sheet, wherein in the connecting portion, a cutout portion formed in the other end side of the first shaft portion and a convex portion formed in one end of the second shaft portion are fitted to each other, and are pivotably connected to each other.

2. The sheet transporting member according to claim 1, wherein the first posture and the second posture of the covering member are changed over by moving the covering member in an axial direction of the first shaft portion.

3. A sheet transporting device comprising:

the sheet transporting member according to claim 1; and a driving source that applies a rotational driving force to the one end side of the first shaft portion.

4. An image forming apparatus comprising:

the sheet transporting device according to claim 3; and an image forming section that forms an image on a recording medium transported by the sheet transporting device.

* * * * *